US007237424B2

(12) United States Patent
Crutchley

(10) Patent No.: US 7,237,424 B2
(45) Date of Patent: Jul. 3, 2007

(54) SPLIT DIE FOR FORMING GROOVED WORKPIECE

(75) Inventor: Derek Crutchley, Warrington (GB)

(73) Assignee: Avdel UK Limited (GB)

( * ) Notice: Subject to any disclaimer, the term of this patent is extended or adjusted under 35 U.S.C. 154(b) by 132 days.

(21) Appl. No.: 10/517,715

(22) PCT Filed: Apr. 15, 2003

(86) PCT No.: PCT/GB03/01619

§ 371 (c)(1),
(2), (4) Date: Jun. 16, 2005

(87) PCT Pub. No.: WO2004/002652

PCT Pub. Date: Jan. 8, 2004

(65) Prior Publication Data

US 2005/0233813 A1 Oct. 20, 2005

(30) Foreign Application Priority Data

Jun. 28, 2002 (GB) ..... 0214959.9

(51) Int. Cl.
*B21K 1/60* (2006.01)

(52) U.S. Cl. ..... 72/401; 72/402; 72/370.04; 72/370.16; 470/10; 470/29; 470/84

(58) Field of Classification Search ..... 72/402, 72/401, 370.04, 398, 370.05, 370.06, 370.08, 72/370.16, 370.18; 470/14, 9, 10, 84, 58, 470/185, 29; 411/395
See application file for complete search history.

(56) References Cited

U.S. PATENT DOCUMENTS 687,464 A * 11/1901 Sullivan
2,856,617 A * 10/1958 Widmann ..... 470/14
3,424,212 A * 1/1969 Kemper ..... 81/436
3,889,511 A * 6/1975 Bayle ..... 72/370.05
4,642,010 A * 2/1987 Bradley et al. ..... 411/69
4,869,629 A * 9/1989 Witzigman ..... 411/38
5,199,751 A * 4/1993 Beagle et al. ..... 285/256
5,894,753 A 4/1999 Sachot et al.
6,178,802 B1 * 1/2001 Reynolds ..... 72/402

FOREIGN PATENT DOCUMENTS

| | | |
|---|---|---|
| DE | 32 45 055 A1 * | 6/1984 |
| EP | 0 351 702 A2 | 1/1990 |
| EP | 0 502 746 A1 | 9/1992 |
| FR | 2 683 167 A1 | 5/1993 |
| GB | 1 030 512 | 5/1966 |
| GB | 1 339 970 | 12/1973 |
| NL | 7901892 | 9/1980 |

* cited by examiner

*Primary Examiner*—Daniel C Crane
(74) *Attorney, Agent, or Firm*—Trexler, Bushnell, Giangiorgi, Blackstone & Marr, Ltd

(57) ABSTRACT

A method of forming a radially expandable externally grooved tubular fastener from metal, comprising the steps of providing a suitable tubular blank (11) having a tubular wall (12) and squeezing the tubular wall between an internal member (17) with a surface which engages the internal tubular wall face (15) of the blank and a plurality of external members (18) provided with suitably shaped surfaces engaging the external tubular wall face (16) of the blank (11) thereby to form grooves (23) on the external tubular wall face (15) of the blank (11).

11 Claims, 13 Drawing Sheets

SPLIT DIE FOR FORMING GROOVED WORKPIECE

RELATED/PRIORITY APPLICATION

This application is a National Phase filing regarding International Application No. PCT/GB03/01619, which relies upon British Application No. 0214959.9 for priority.

The invention relates to a method of forming a tubular fastener, and more particularly to a method of forming a radially expandable externally grooved tubular fastener from metal.

Such fasteners are used to fasten together two or more workpieces by inserting a fastener in a suitable aperture through the workpieces, and radially expanding at least part of the tubular fastener so as to engage the workpieces. Commonly the tubular fastener is provided with a radially enlarged head at one end which contacts the face of the nearer workpiece. In this case the fastener may engage all of the workpieces, or only the workpiece most remote from the head. Radial expansion of the tubular fastener may be achieved by pushing or pulling through Its bore the head of a mandrel.

Such fasteners and their method of installation are well-known in the mechanical assembly industry.

The present invention aims to provide an improved and simplified method of forming such fasteners, needing few manufacturing operations.

The invention provides, in one of its aspects, a method of forming a radially expandable externally grooved tubular fastener from metal, as defined in claim 1 of the accompanying claims. Further preferred features of the present invention are sat out in claims 2 to 16. The invention includes a fastener manufactured by a method according to the invention.

Some specific embodiments of the present invention will now be described by way of example and with reference to the accompanying drawings, In which:

FIGS. 1A to AH and 1J to 1N, 1A to 1N illustrate a first method;

FIGS. 2A to 2K, 2A to 2H, 2J and 2K illustrate a second method;

FIGS. 3A to 3H and 3J to 3M, 3A to 3M illustrate a third method.

In FIGS. 1, 2 and 3, the individual figures suffixed "A", "B", "C" etc. through to "K" are, in general, corresponding views respectively on the three example methods.

Figure 1A:
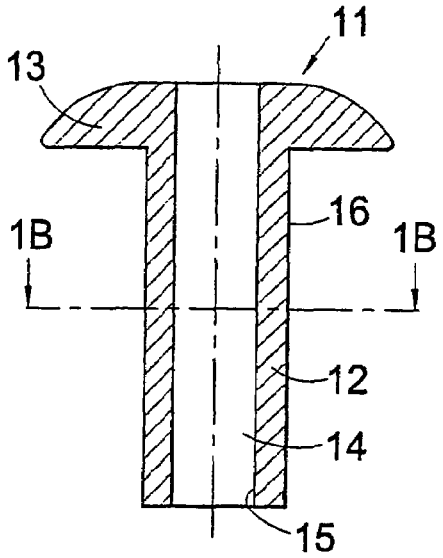
Figure 1B:
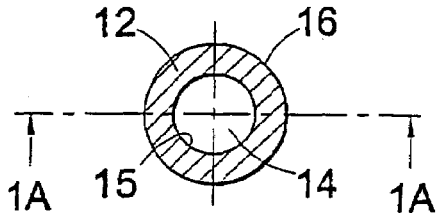
Figure 1C:
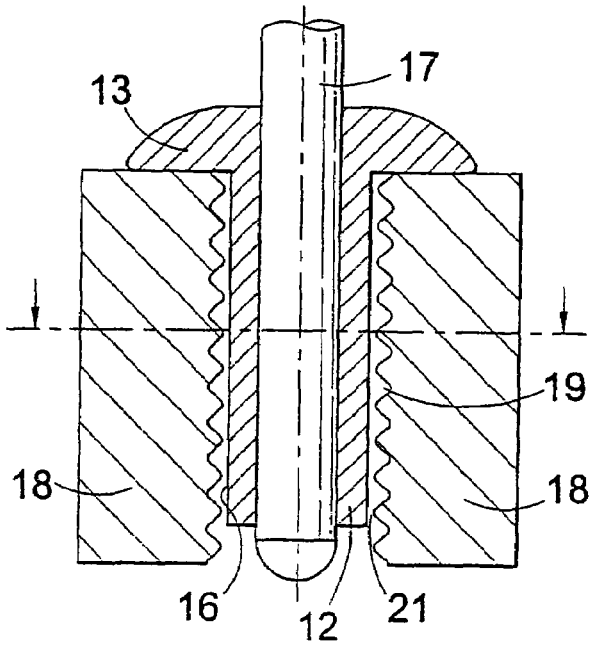
Figure 1D:
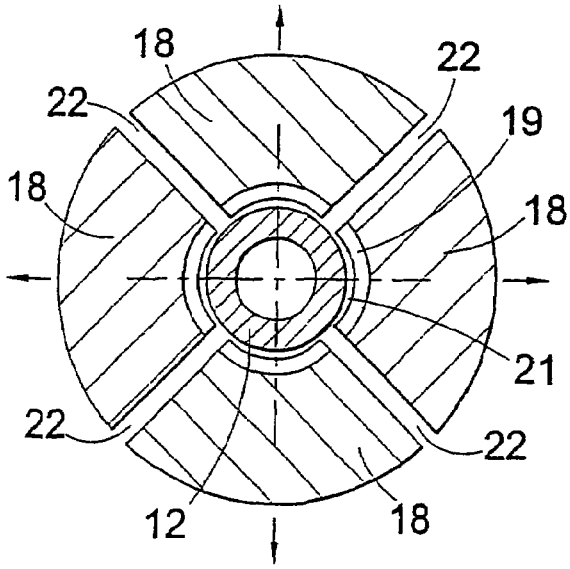
Figure 1E:
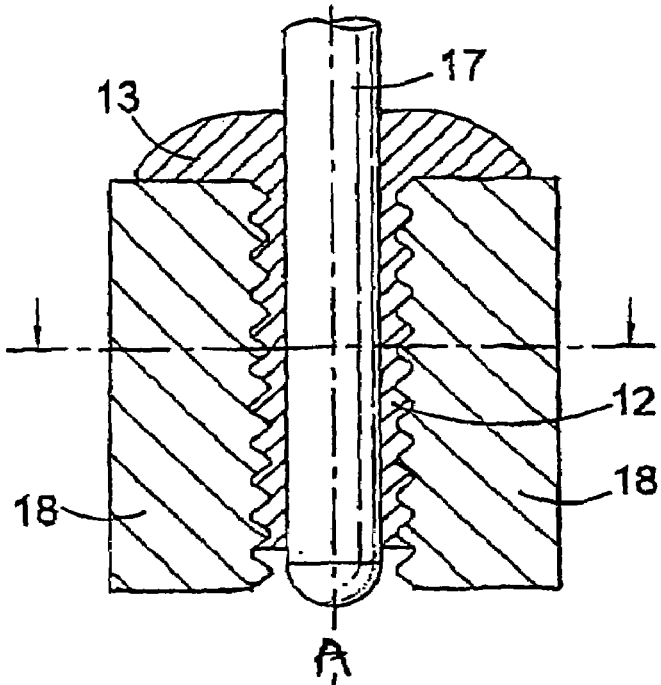
Figure 1F:
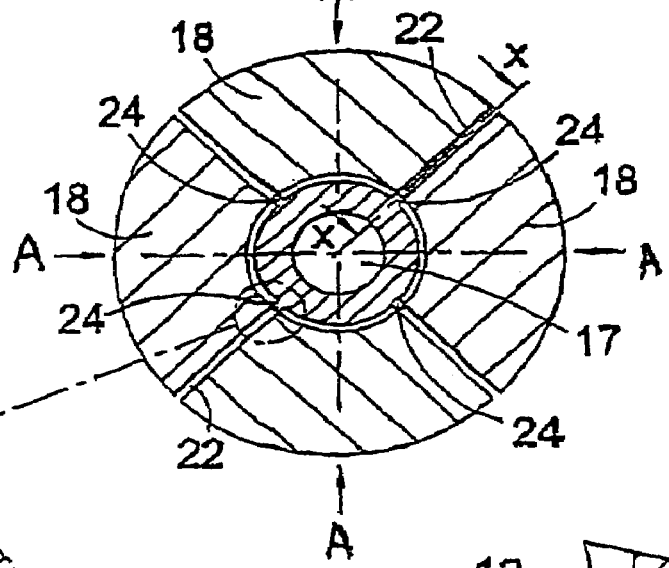
Figure 1M:
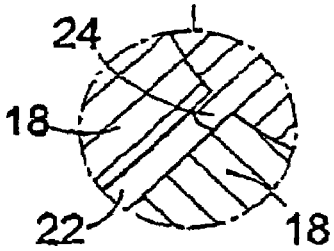
Figure 1L:
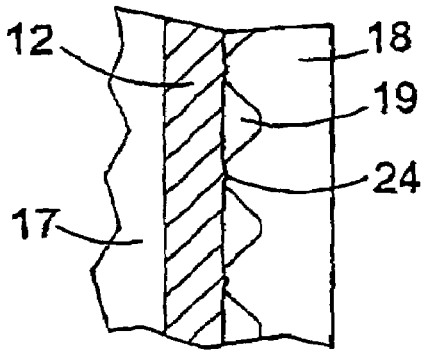
Figure 1N:
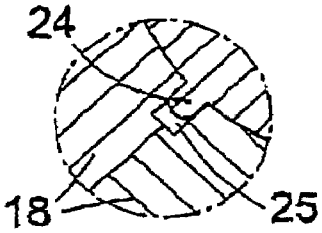

Referring first to the method illustrated in FIGS. 1A to 1N, FIGS. 1A and 1B show the blank used, FIG. 1A being an axial section on the line 1A-1A of FIG. 1B, and FIG. 1B being a cross-section on the line 1B-1B of FIG. 1A. (Most of the remainder of the figures are also in such pairs, one of which is an axial section and the other of which is a cross-section, as is common in engineering drawing practice. Since the reader will be familiar with this, this relationship between the figures of each pair will not be further referred to). The blank 11 has an elongated tubular body wall 12 with a radially enlarged head 13 (in a so-called "pan head" shape at one end). The blank has a cylindrical bore 14 extending throughout its entire length, to provide an internal tubular wall surface 15. The tubular wall 12 has a cylindrical outer surface wall 16.

It will be appreciated that the bore 14 and/or walls 12 and 15 may have non-cylindrical shapes such as tri-roundular or hexagonal shapes.

The internal wall face 15 of the blank is supported on a cylindrical support pin 17 (FIGS. 1C and 1D) which is a close fit in the bore 14.

Outside the tubular wall 12 there are then provided four external die members 18 in the form of a split die. The blank is inserted between them so that (as shown in FIG. 1C) the underside of the head 13 abuts one set of end faces of the members 18, the other ends of which project beyond the tail end of the tubular wall 12 of the blank. The inner face of each member 18, which faces towards the external wall 16 of the body 12, is formed with grooves 19. The members 18 are initially spaced slightly apart, to provide a space 21 into which the body wall 12 of the blank can be introduced with clearance, as shown in FIGS. 1C and 1D. There is a radial gap 22 between adjacent die members 18.

The tubular wall 12 of the blank is then radially squeezed, as illustrated in FIGS. 1E and 1F, by forcing the four die members 18 radially inwardly towards the support pin 17, in the directions indicated by the arrows A in FIG. 1F. The grooved faces of the die members engage the external wall surface 16 of the tubular body wall 12 of the blank, to deform it. The internal wall 15 of the blank is prevented from moving radially inwardly by the contact with the rigid support pin 17. The radially outer part of the body wall 12 is deformed so that it becomes substantially complementary in shape to the shape of the grooves 19 in the die members 18, so that the external surface wall 16 of the tubular body is formed with circumferential grooves 23 (see FIG. 1G). As shown in FIG. 1F, the four die members 18 are closed together only so far as to leave a reduced radial gap 22 between each and the next. These gaps accommodate, and help to form, protrusions 24 which project radially outwardly from the thread formed on the blank. These arise due to the squeezing action on the metal of the tubular wall 12, and are shown in FIG. 1F. They are shown on an enlarged scale in FIG. 1M (which is an enlargement of the part of FIG. 1F indicated), and also in FIG. 1L, which is an enlarged partial section on the line X-X of FIG. 1F. The protrusions 24 are formed in the valleys of the grooves 23 on the wall of the blank and extend radially outwardly to slightly beyond the crests of the grooves. It will be appreciated that the protrusions 24 need not extend beyond the crests of the grooves 23.

An alternative arrangement is illustrated in FIG. 1N, which is an enlargement corresponding to FIG. 1M. In this alternative, side walls of each die 18 are further apart, so that when the grooves 23 on the blank are fully formed, the adjacent walls of the dies 18 are in contact with each other, as illustrated in FIG. 1N. However, a suitable space 25 is left adjacent the grooved faces of the dies, to accommodate the protrusions 24.

Figure 1G:
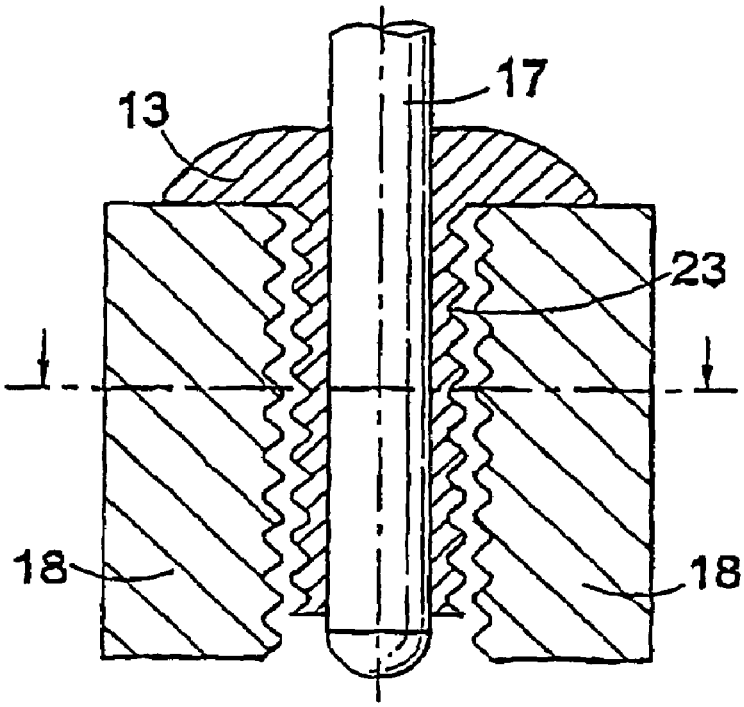
Figure 1H:
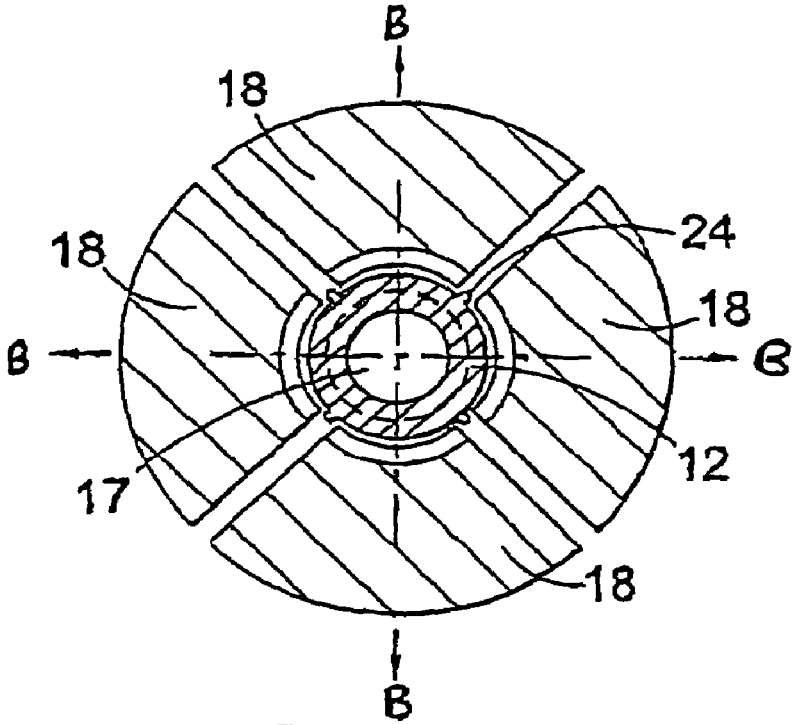
Figure 1J:
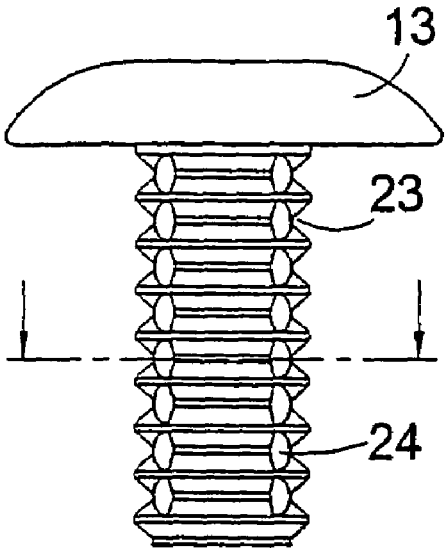
Figure 1K:
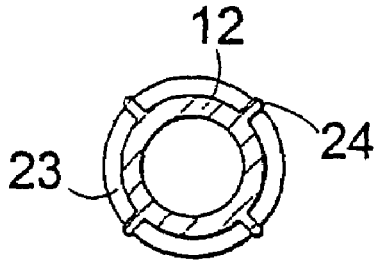

The four dies are then drawn apart again, as illustrated in FIGS. 1G and 1H, with directions indicated by the arrows B in FIG. 1H. This releases the grooves 23 which have been formed on the external surface of the tubular body 11 from inter-engagement with the grooves 19 in the die members. The support pin 17 can then be withdrawn axially from between the dies, carrying the blank with it. The blank can then be pushed off the pin, to leave the formed blank as shown in FIGS. 1J and 1K.

The term "blank" is used at this stage, as a matter of consistency and convenience. It may be that the tubular fastener has been fully manufactured at this stage. Alternatively it may be that the grooved blank is subject to further manufacturing stages, for example heat treatment and/or surface treatment.

A second example of the method according to the invention is illustrated in FIGS. 2A to 2K, which as previously mentioned correspond to FIGS. 1A to 1K respectively, like parts being indicated by like reference numerals. This second method is generally similar to the first method, and may be considered as a modification thereof. Accordingly the second method will be described in detail only where it differs from the first.

Figure 2A:
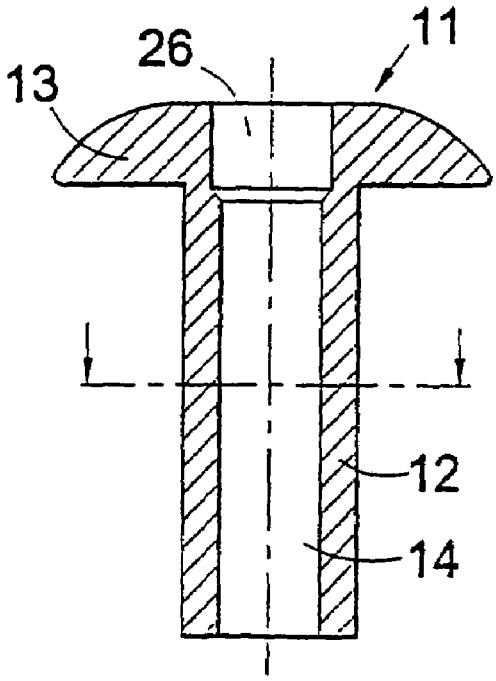

As shown in FIG. 2A, the head 13 of the blank 11 is formed with a counterbore 26. The end face 34 of support pin 17 (FIG. 2C) is in contact with the end face 35 of expander pin 36 which is formed with expander part 27 or larger diameter, merging with the diameter of the support pin by a conical taper 28. The four dies 18 are initially closed together so that there are no radial gaps between their side faces, and their radially inner grooved surfaces provide a small gap with the external wall 16 of the tubular body wall 12 of the blank, as illustrated in FIGS. 2C and 2D. The support pin 17 is then pulled with respect to the blank, in the direction towards the head 13 of the blank, i.e. upwards as sown in FIG. 2C. The taper 28 and then the expander portion 27 progressively enter the bore 14 of the blank. The blank is prevented from moving axially upwards by a support tool 29 which contacts the blank head 13 and which takes up the reaction force. The tubular body wall 12 is thus radially expanded, so that its outer part is squeezed into the grooves 19 in the die members, thus forming external circumferential grooves in the tubular wall. The counterbore 26 within the head 13 of the blank accommodates the expander portion 27, so that the head 13 is not radially expanded. This is the position illustrated in FIGS. 2E and 2F. Since there are no radial gaps between the dies 18, no protrusions from the grooved external face of the blank are formed. The dies 18 are then withdrawn radially, as shown in FIGS. 2G and 2H, and the externally grooved blank is pushed off the expander section 27 to provide the result illustrated in FIGS. 2J and 2K. Protrusions may be formed by leaving radial gaps between the dies as for the first method described above.

The third example method shown in FIGS. 3A to 3M may be considered as combining features of the first two methods, in that it combines an effective decrease in the diameter of engagement of the external die surfaces and an increase in the diameter of engagement of the internal support.

Figure 2B:
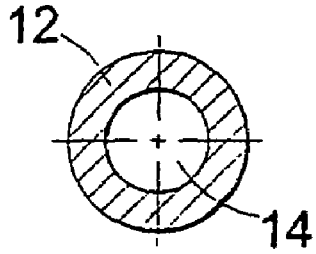
Figure 2C:
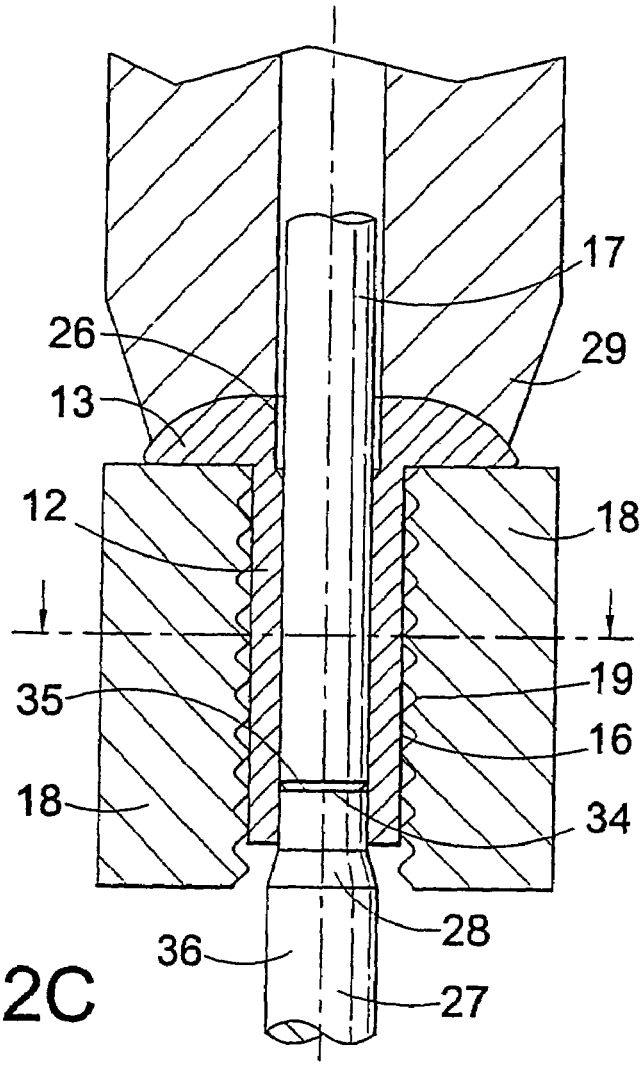
Figure 2D:
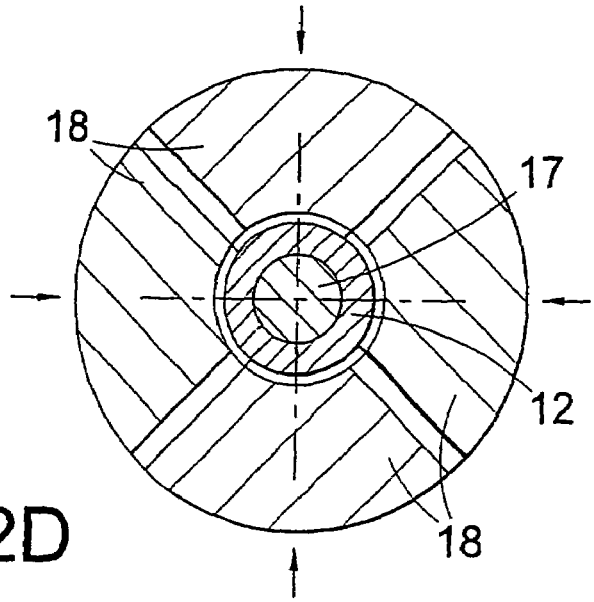
Figure 2E:
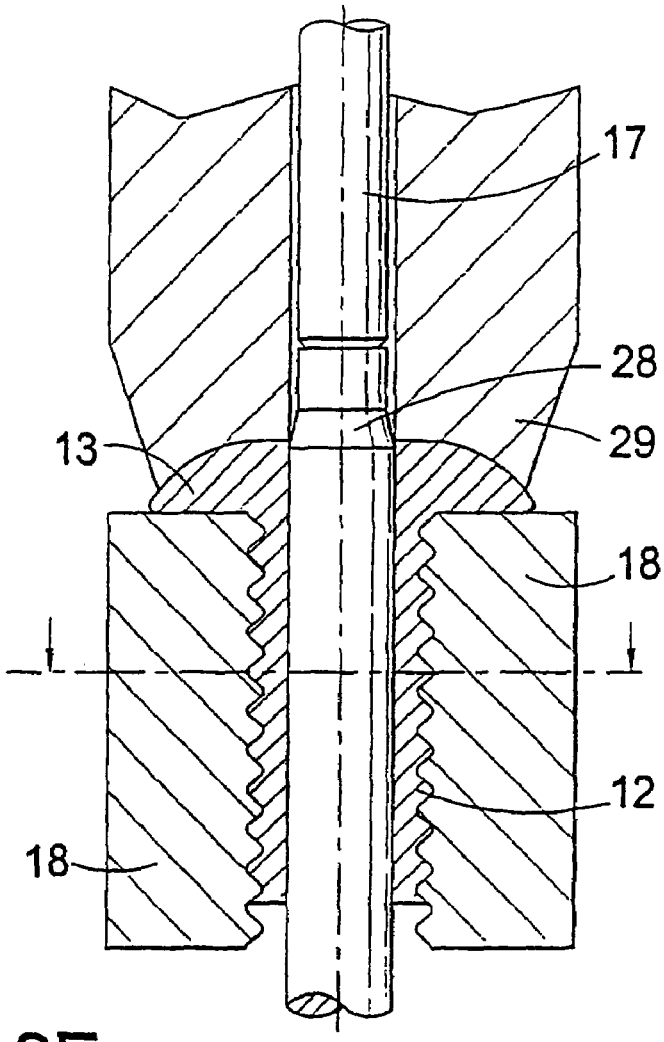
Figure 2F:
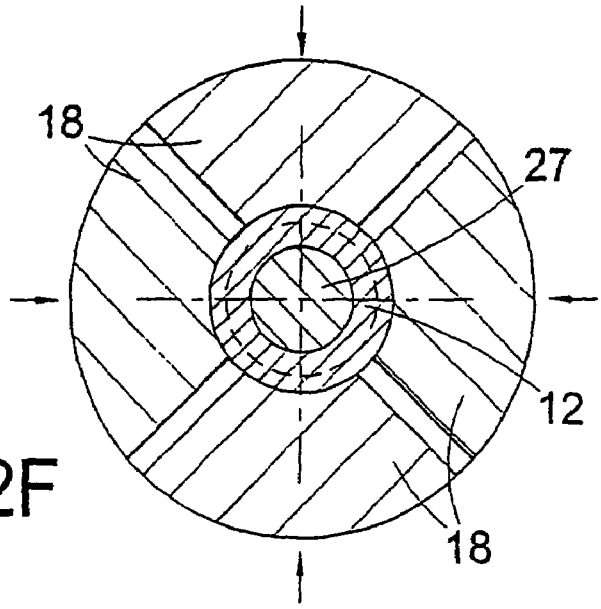
Figure 2G:
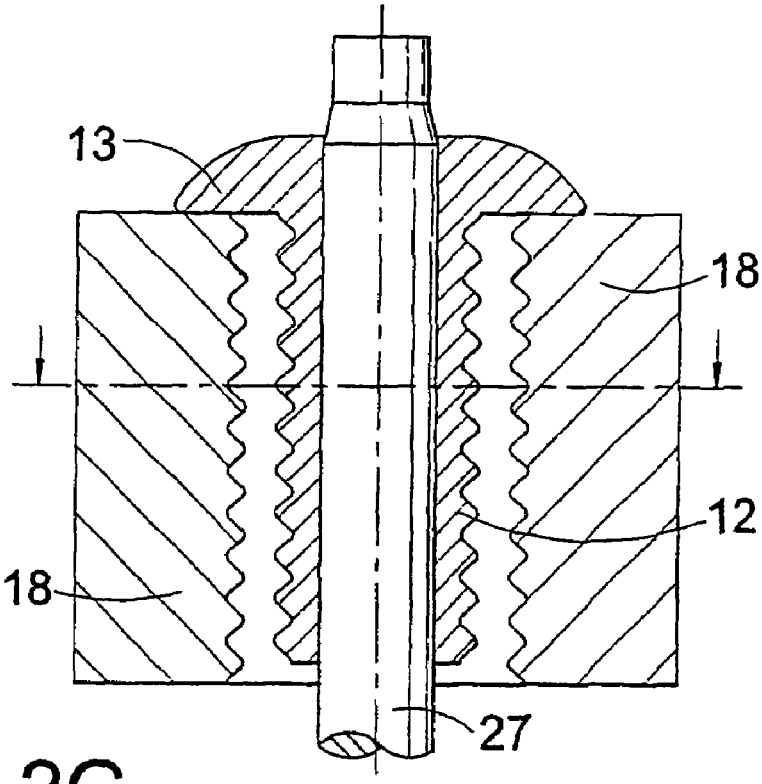
Figure 2H:
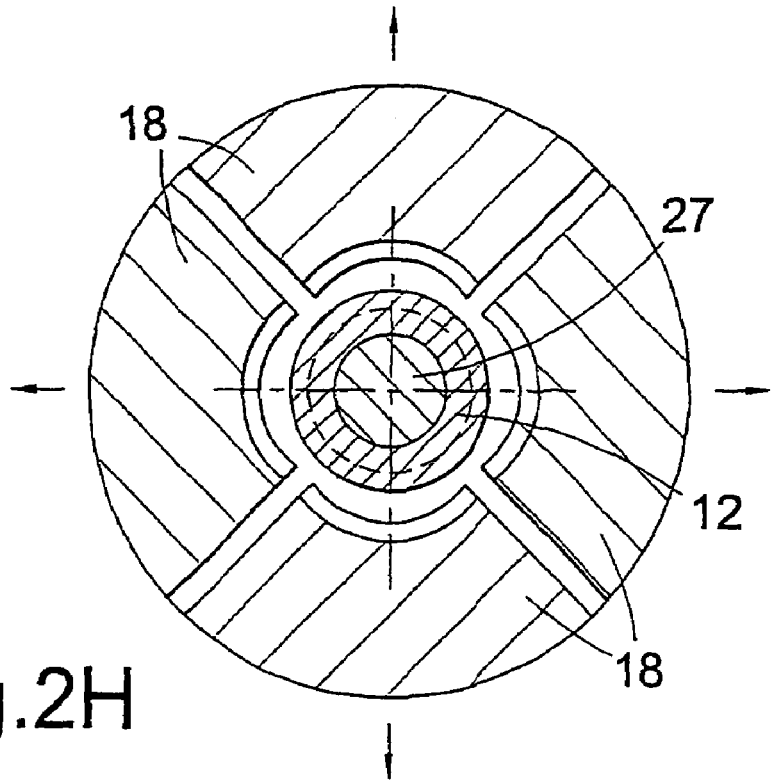
Figure 2J:
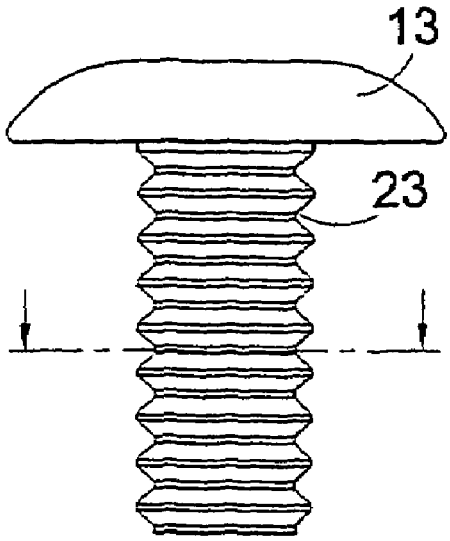
Figure 2K:
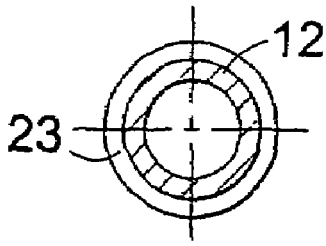
Figure 3A:
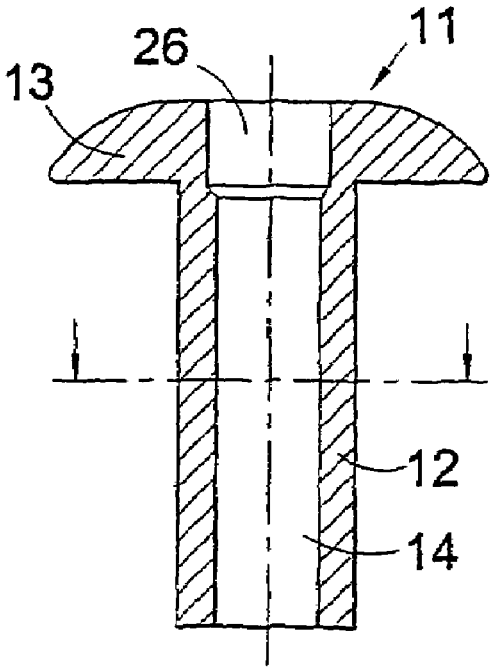
Figure 3B:
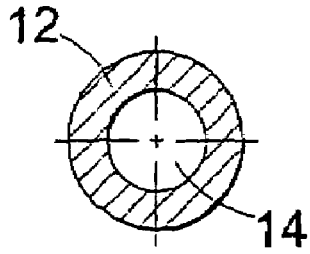
Figure 3C:
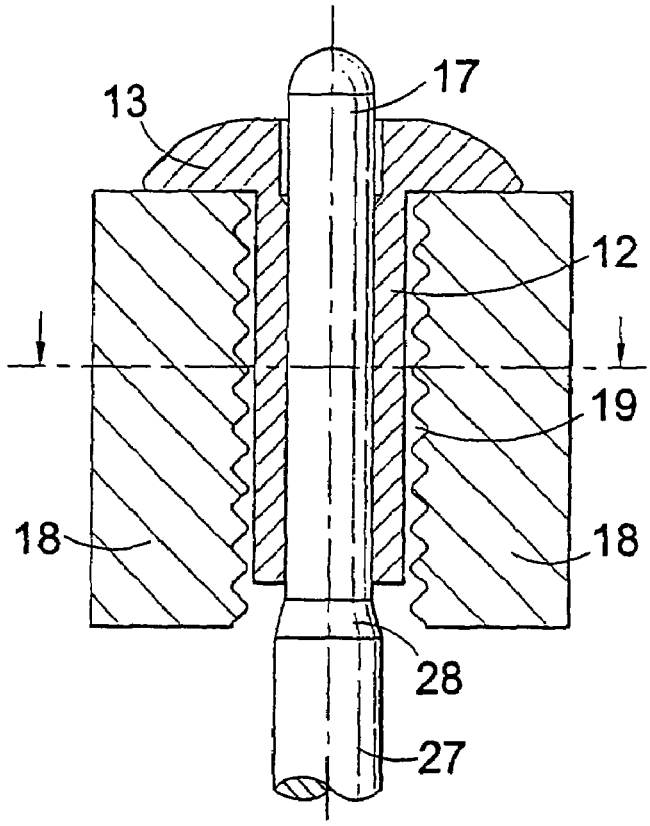
Figure 3D:
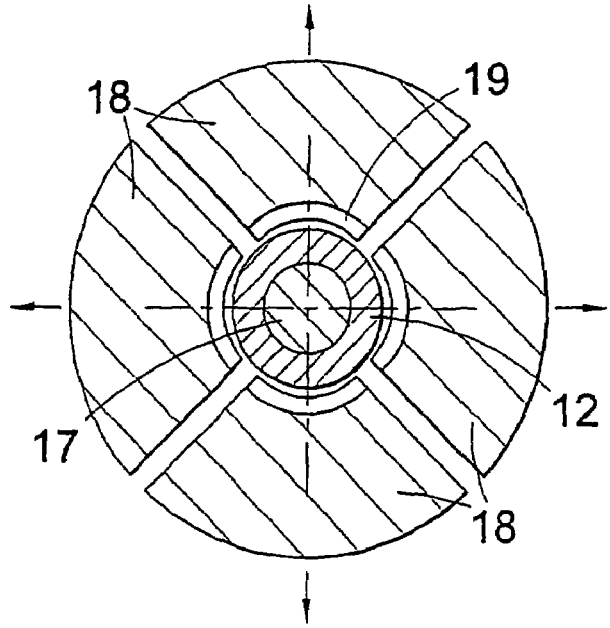
Figure 3E:
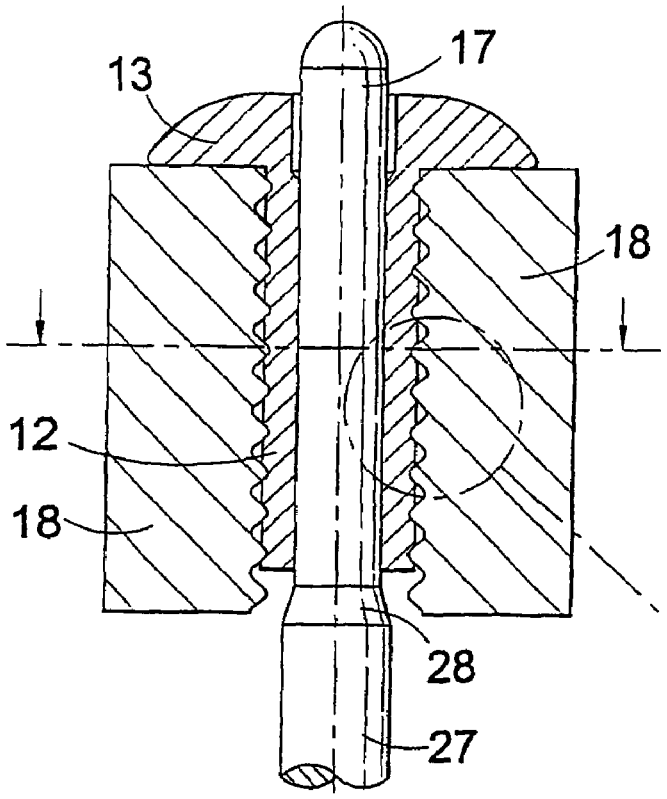
Figure 3L:
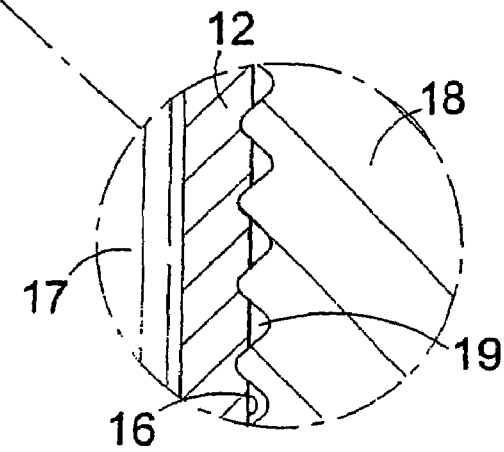
Figure 3F:
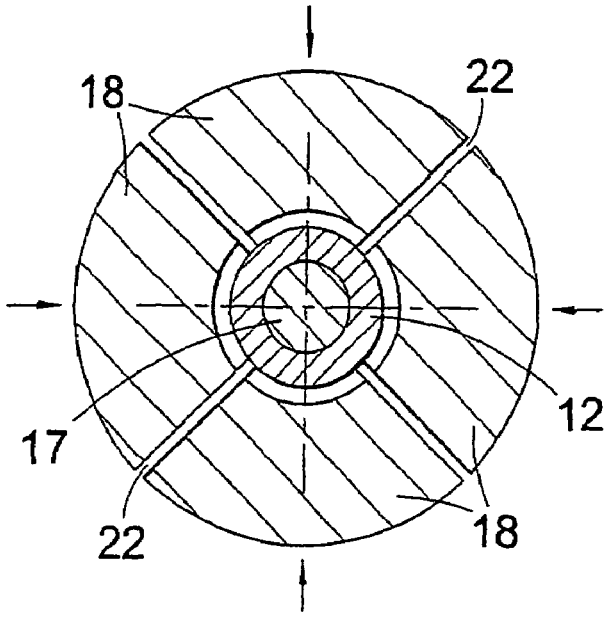
Figure 3G:
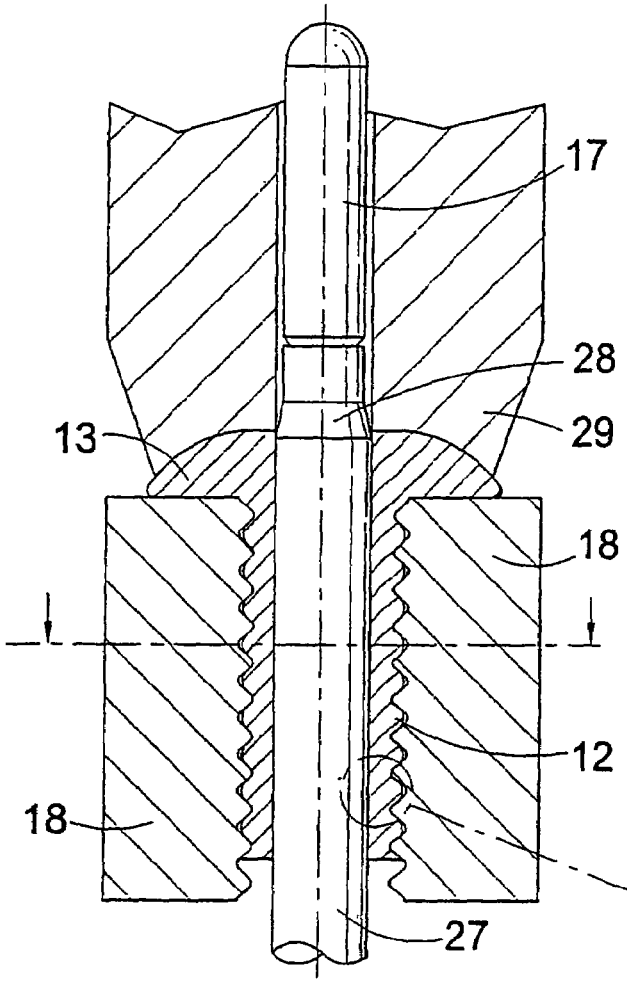
Figure 3M:
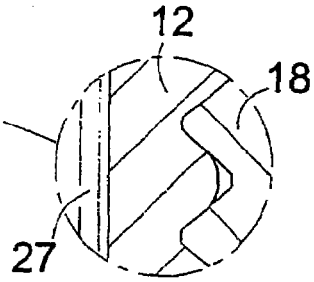
Figure 3H:
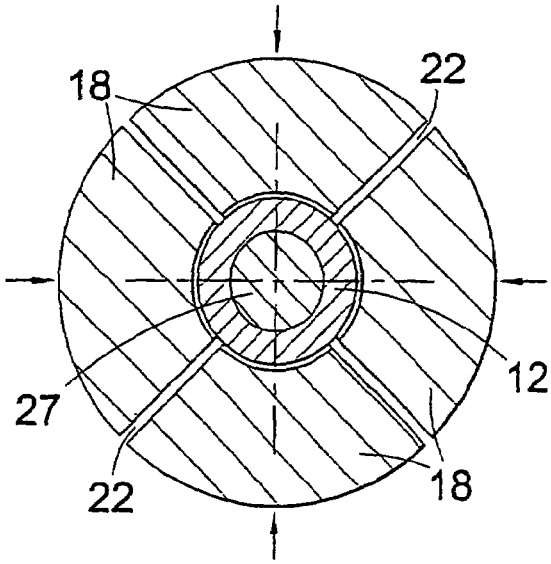

As shown in FIGS. 3A and 3B, the blank 11 is identical with that shown in FIGS. 2A and 2B and used on the second example method. Likewise the support pin 17 is joined by a taper 28 to an expander position 27 of enlarged diameter. As shown in FIGS. 3C and 3D, initially the blank is placed on the support pin 17 and inserted between the grooved inner walls of the dies 18. The dies are then advanced radially inwardly to the position shown in FIGS. 3E and 3F, in which the ridges between the grooves in the dies partially enter the outer surface wall 16, as shown in FIGS. 3E and 3F, and more clearly in the enlargement in FIG. 3L. The body wall 12 is supported against inward deformation by the support pin 17. The support pin 17 is then pushed axially upwards into the tubular blank, against the reaction of a support tool 29 contacting the head 13 of the blank, so that the expander portion 27 enters the bore of the tubular wall 12 and radially expands it. The outer part of the wall material is thus forced into the grooves in the dies, as illustrated in FIGS. 3G and 3H. As shown in enlargement FIG. 3M, the material may not completely fill the grooves in the dies.

Figure 3J:
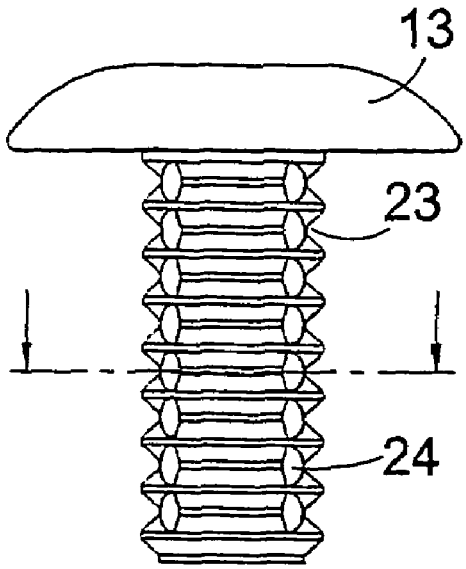
Figure 3K:
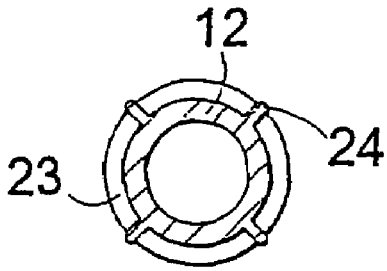

The dies are then withdrawn radially to release engagement with the blank, which is then pushed off the expander portion 27 to provide the result illustrated in FIGS. 3J and 3K. As shown in FIG. 3H, when the dies 18 are together, there are radial gaps 22 between them, so that as shown in FIGS. 3J and 3K protrusions 24 are thrown up.

In the foregoing examples, the material of the blank is aluminium 5052, containing 2.5% magnesium. After forming, the length of the tubular body or shank is 7.0 mm, its external diameter is 3.4 mm, the internal diameter of its bore is 1.6 mm, the diameter of the head of 6.0 mm, and the thickness of the head is 0.9 mm. It will be noted that other materials and/or dimensions may be used.

Figure 4A:
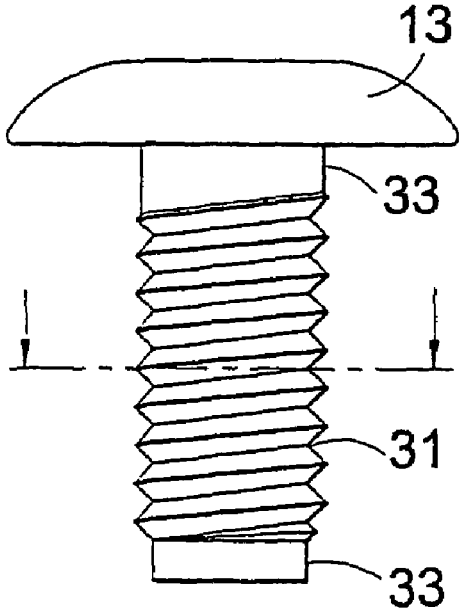
FIGS. 4A and 4B, 5A and 5B, and 6A and 6B illustrate possible alternative groove configurations for a formed tubular fastener.
Figure 4B:
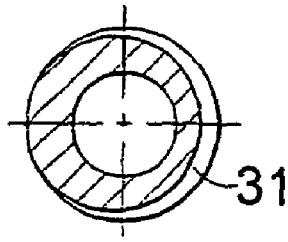
Figure 5A:
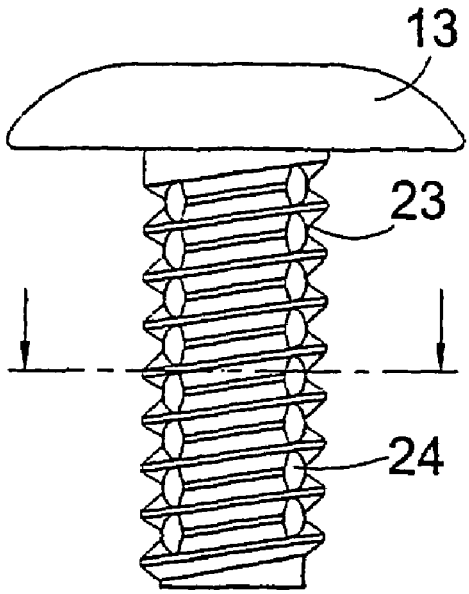
Figure 5B:
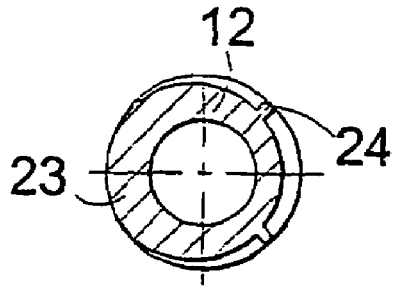
Figure 6A:
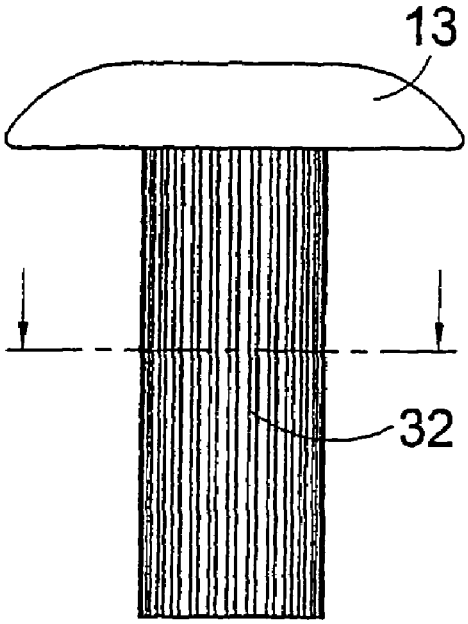
Figure 6B:
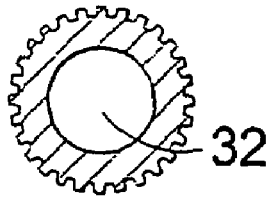

The invention is not restricted to the details of the foregoing examples. For instance, by providing grooves 19 of suitable form on the inner faces of the die members 18, external grooves of the other desired configurations may be formed on the external tubular wall of the blank. Thus, FIGS. 4A and 4B illustrate a fastener with a helical groove 31, which provides a screw-thread (which could be considered as comprising a number of circumferential or near-circumferential grooves joined together to form a helical groove). There may be an unthreaded portion 33 at one or both ends of the threaded portion. If such a helical thread were formed by the method of the first foregoing example, radial protrusions would be formed, which would provide resistance to unscrewing the installed fastener. This is illustrated in FIGS. 5A and 5B FIGS. 6A and 6B illustrate a fastener with longitudinal grooves 32. The method of the present invention provides for the formation of a tubular fastener with grooves of all these, and other, configurations.

The invention claimed is:

1. A method of forming a radially expandable externally grooved tubular fastener from metal, comprising the steps of:

providing a suitable tubular blank having a tubular wall;

and squeezing the tubular wall between a support pin with a surface which engages the internal tubular wall face of the blank and a plurality of external members provided with suitably shaped surfaces engaging the external tubular wall face of the blank;

thereby to form grooves on the external tubular wall face of the blank;

in which the squeezing is achieved by the effective decrease in diameter of the external members which are engaged with the external tubular wall face of the blank; and in which the external members are closed on to the external wall face of the tubular blank to form grooves thereon and then remain in the same spatial relationship with each other until they are withdrawn to release the blank, and wherein the internal tubular wall face of the blank is prevented from moving radially inwardly by the support pin.

2. A method as claimed in claim 1, in which the squeezing is achieved by both the effective increase in diameter of the engagement of the support pin with the internal tubular wall face of the blank and the effective decrease in the diameter of engagement of the suitably shaped surfaces of the external members with the external tubular wall face of the blank.

3. A method as claimed in claim 1, in which the external members when closed on to the external tubular wall face of the blank form grooves thereon and also form a plurality of radially extending protrusions thereon.

4. A method as claimed in claim 3, in which the external members are closed on to the external tubular wall face of the blank so as to leave a space between each member and the next, thereby to accommodate the protrusions from the grooves.

5. A method as claimed in claim 4, in which opposed walls of adjacent external members which define the spaces between them also assist in forming the protrusions.

6. A method as claimed in claim 2, in which the external members are first progressively closed on to the external tubular wall face of the blank to as to engage it and at least partially form grooves in it, and the support pin engages the internal tubular wall face of the blank with an increasing diameter, thereby to assist in the formation of the grooves.

7. A method as claimed in claim 2, in which the support pin has an external diameter which varies along its length, and is moved axially with respect to the tubular blank thereby to increase the diameter which engages the internal tubular wall face of the blank as aforesaid.

8. A method as claimed in claim 1, in which the grooves on the external tubular wall face of the blank are in the form of circumferential grooves.

9. A method as claimed in claim 1, in which the grooves on the external tubular wall face of the blank are in the form of a screw thread.

10. A method as claimed in claim 1, in which the grooves on the external tubular wall of the blank are in the form of longitudinal grooves.

11. A method of forming a radially expandable externally grooved tubular fastener from metal, comprising the steps of:

providing a suitable tubular blank having a tubular wall;

and squeezing the tubular wall between a support pin with a surface which engages the internal tubular wall face of the blank and a plurality of external members provided with suitably shaped surfaces engaging the external tubular wall face of the blank;

thereby to form grooves on the external tubular wall face of the blank;

in which the support pin engages the internal tubular wall of the blank at an unchanging diameter, and the external members are progressively closed on to the external wall face of the tubular blank to form grooves thereon and are then withdrawn from engagement with the external tubular wall face of the blank thereby to release the grooved blank, wherein the external members when closed on to the external tubular wall face of the blank form grooves thereon and also form a plurality of radially extending protrusions thereon, and wherein the internal tubular wall face of the blank is prevented from moving radially inwardly by the support pin, and in which the external members are closed on to the external tubular wall face of the blank so as to leave a space between each member and the next, thereby to accommodate the protrusions from the grooves.

* * * * *